US009512388B2

(12) United States Patent
Meier et al.

(10) Patent No.: US 9,512,388 B2
(45) Date of Patent: Dec. 6, 2016

(54) SOLID STATE DETERGENT IN A TRANSPARENT CONTAINER

(71) Applicants: The Dial Corporation, Scottsdale, AZ (US); Henkel AG & Co. KGaA, Duesseldorf (DE)

(72) Inventors: Frank Meier, Duesseldorf (DE); Nicole Bode, Duesseldorf (DE); Rainer Geberzahn, Juechen (DE); Dieter Nickel, Pulheim (DE); Kathrin Schnepp-Hentrich, Monheim (DE); Bin Lin, Scottsdale, AZ (US); Marc Maslanka, Scottsdale, AZ (US); Pamela Lam, Scottsdale, AZ (US); Mark C. Mikol, Phoenix, AZ (US); Martin Zethoff, Bochum (DE)

(73) Assignees: HENKEL AG & CO. KGAA, Duesseldorf (DE); THE DIAL CORPORATION, Scottsdale, AZ (US)

( * ) Notice: Subject to any disclaimer, the term of this patent is extended or adjusted under 35 U.S.C. 154(b) by 16 days.

(21) Appl. No.: 14/625,412

(22) Filed: Feb. 18, 2015

(65) Prior Publication Data

US 2016/0237386 A1 Aug. 18, 2016

(51) Int. Cl.
*C11D 17/06* (2006.01)
*C11D 17/04* (2006.01)

(52) U.S. Cl.
CPC ..... *C11D 17/06* (2013.01); *C11D 17/046* (2013.01)

(58) Field of Classification Search
CPC ..... B65D 83/06; A47L 15/44
See application file for complete search history.

(56) References Cited

U.S. PATENT DOCUMENTS

| | | | | |
|---|---|---|---|---|
| 4,518,516 | A | 5/1985 | Godard et al. | |
| 4,549,977 | A * | 10/1985 | Joshi | B65D 23/10 215/398 |
| 5,703,034 | A * | 12/1997 | Offshack | C11D 3/3932 510/220 |
| 6,468,957 | B1 | 10/2002 | Larson et al. | |
| 6,534,471 | B1 | 3/2003 | Block et al. | |
| 6,683,042 | B1 | 1/2004 | Larson et al. | |
| 6,900,165 | B2 | 5/2005 | Meffert et al. | |
| 7,186,677 | B2 | 3/2007 | Raehse et al. | |
| 2002/0052303 | A1 | 5/2002 | Capeci et al. | |
| 2007/0290013 | A1 * | 12/2007 | Yamane | B65D 41/26 222/547 |

FOREIGN PATENT DOCUMENTS

| | | | |
|---|---|---|---|
| EP | 0451893 | B1 | 3/1997 |
| EP | 0931137 | B1 | 12/2003 |
| EP | 2639291 | A1 | 9/2013 |

* cited by examiner

*Primary Examiner* — Gregory Webb
(74) *Attorney, Agent, or Firm* — Fabian VanCott; St

(57) ABSTRACT

Methods and apparatus are provided for containing and dispensing a particulate detergent composition. The apparatus includes a transparent container. The transparent container holds a solid state particulate detergent composition. The apparatus also includes a solid state particulate detergent composition. The solid state particulate detergent composition includes a number of surfactants.

25 Claims, 3 Drawing Sheets

SOLID STATE DETERGENT IN A TRANSPARENT CONTAINER

FIELD OF THE INVENTION

The present invention generally relates to solid state detergents and containers therefor, and more particularly relates to solid state detergent mixtures in transparent containers.

BACKGROUND OF THE INVENTION

Detergents may be presented as either a liquid or a powder. Consumer pressures have changed the appearance of detergent powders, resulting in the introduction of colored particles and optical brighteners to ensure the detergent powder appears white.

The production of a consumer-acceptable powdered detergent presents a number of challenges. For example, the production of detergent particles (such as by granulation or spray drying) can produce a great diversity of particle sizes, providing a powdered detergent that is quite heterogeneous in particle size. Particles that are too small appear dust-like, and cause portions of the detergent to be unable to be captured or used by a consumer. Additionally, dust-like particles may present an inhalation risk when dispensing a powdered detergent. By comparison, particles that are too large may not dissolve completely, thus decreasing the efficacy of the powdered detergent and may lead to powder residues in the washing machine or on the laundry, causing consumer frustration. In certain environments, powdered detergents may also agglomerate into clumps, causing the powdered detergent to be difficult to measure and/or dispense.

Powdered detergents may be provided in opaque boxes. The interior of the boxes may be coated in order to make the powdered detergent appear more white. While this may provide a low-cost packaging method, it is difficult for a consumer to quantify the amount of detergent remaining in a box, or to translate that amount into a number of laundry loads for which there is sufficient detergent. Packaging the detergent in a box also allows the detergent to accumulate in the corners and under the folds of the box, further challenging the quantification of the remaining detergent by a consumer, and causing portions of the detergent to be inaccessible.

Accordingly, it is desirable to provide a powdered detergent that remains white, produces a pleasant scent, and remains as free-flowing particles of a relatively homogenous size over time. Additionally, it is desirable to provide a powdered detergent in a transparent container, in order to enable a consumer to readily quantify the remaining detergent, and to verify that all of the detergent has been used prior to discarding the container. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A consumer product is provided for containing and dispensing a particulate detergent composition. The consumer product includes a transparent plastic container, and a particulate detergent composition. The particulate detergent composition contains less than 5% by weight of particles with a diameter of less than 0.2 millimeters (mm), contains less than 1% by weight of particles with a diameter of less than 0.1 mm, and contains less than 0.6% by weight of particles with a diameter of less than 0.05 mm; all weights are relative to the total weight of the particulate detergent composition.

A cleansing product is provided for use as a laundry detergent. The cleansing product includes a transparent container to hold a solid state laundry detergent composition, and a solid state laundry detergent composition that includes a number of surfactants and extruded particles.

A consumer product is provided for containing and dispensing a particulate laundry detergent. The consumer product includes a transparent plastic container that is made from a material that has a degree of light transmission of at least 60%, and a particulate laundry detergent composition. The particulate laundry detergent composition includes from 10% to 40% by weight of a number of anionic surfactants, and from 1% to 30% by weight of a number of nonionic surfactants; all weights are relative to the total weight of the particulate detergent composition.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
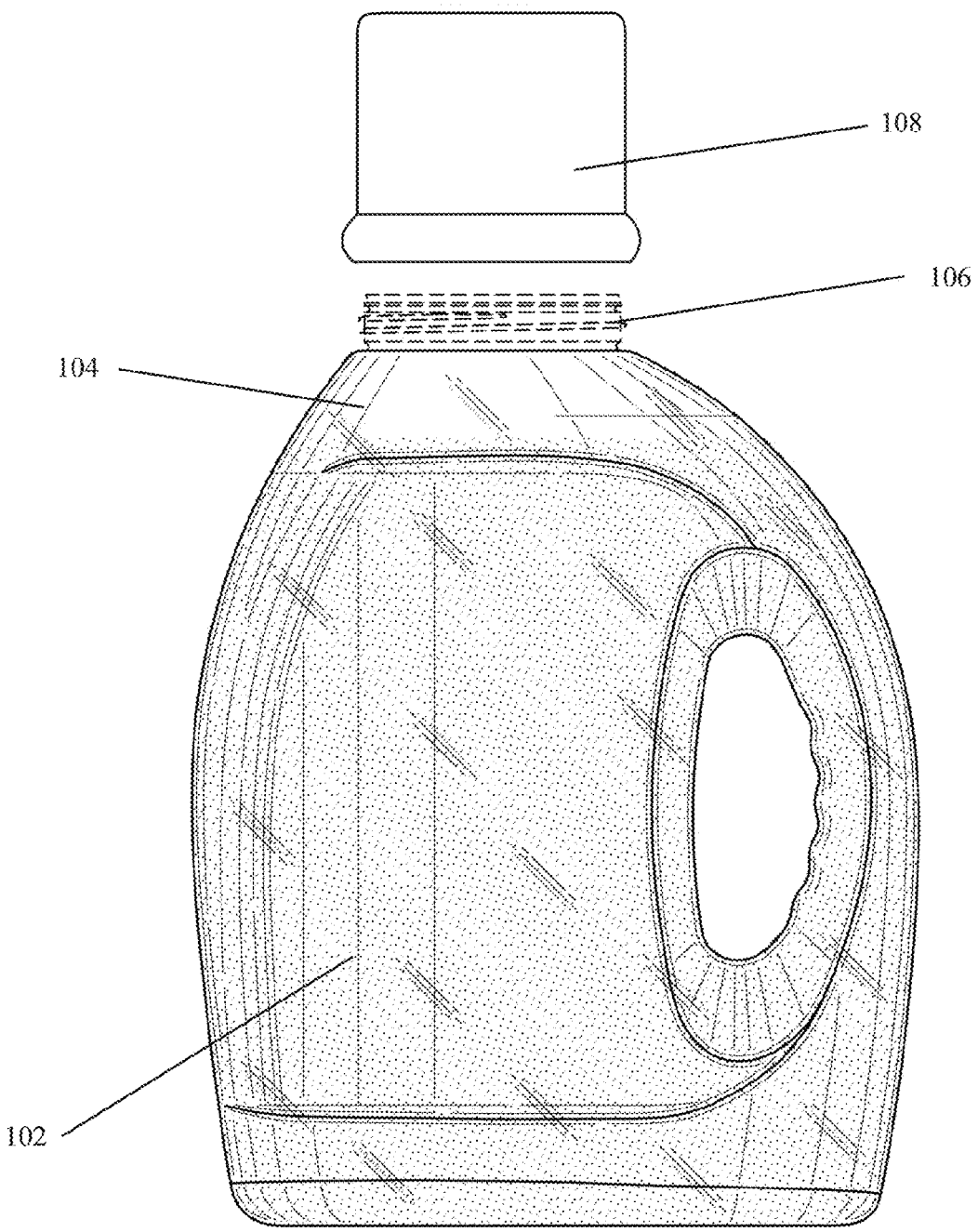
FIG. 1 is a diagram of a cleansing product according to an example of the principles described herein.

The following detailed description of the invention is merely exemplary in nature and is not intended to limit the invention or the application and uses of the invention. Furthermore, there is no intention to be bound by any theory presented in the preceding background of the invention or the following detailed description of the invention.

As noted above, the production of a consumer-acceptable powdered detergent presents a number of challenges. For example, it may be desirable for the powdered detergent to be relatively homogenous in particle size, and to prevent particles that are too small and dust-like, or too large to readily dissolve. In another example, a narrow particle size distribution of a powdered or particulate detergent may prevent an undesirable segregation of the constituents of the detergent, which may otherwise occur due to granular convection. It may also be desirable for a powdered detergent to have a number of consumer-acceptable qualities, such as a pleasant fragrance, white appearance, and to not readily agglomerate into clumps. Additionally, it may be desirable for a powdered detergent to have a relatively high density, so as to reduce the cost of packaging, storage, and transport. The container in which a powdered detergent is provided may also contribute to a consumer's satisfactory experience with a product. Accordingly, it may be desirable to provide a powdered detergent in a container that allows a consumer to readily dispense all of the detergent, while also allowing facile quantification of the amount of detergent remaining.

Products according to the present specification may provide each of the above properties. According to one example, such a product may be a laundry detergent in a container that allows a consumer to readily quantify the amount of detergent remaining in the container as a number of loads of laundry for which the detergent can be used. In another example, such a product may be a detergent in a transparent bottle, so that a consumer may readily identify the amount of detergent that remains as a number of washing machine loads for which the detergent can be used.

A consumer product is provided for containing and dispensing a particulate detergent composition. The consumer product includes a transparent plastic container, a particulate detergent composition, and a cap to removably seal the transparent plastic container. The particulate detergent composition contains less than 5% by weight of particles with a diameter of less than 0.2 millimeters (mm), less than 1% by weight of particles with a diameter of less than 0.1 mm, and less than 0.6% by weight of particles with a diameter of less than 0.05 mm; all weights are relative to the total weight of the particulate detergent composition. The cap acts as a measurement tool for the particulate detergent composition.

A cleansing product is provided for use as a laundry detergent. The cleansing product includes a solid state laundry detergent composition that includes extruded particles and a number of surfactants, a transparent container to hold the solid state laundry detergent composition, and a cap selectively engaged with the transparent container, in which the cap provides a measurement tool for the solid state laundry detergent composition.

A method is provided for dispensing a particulate detergent composition from a container. The method includes removing a cap from a transparent container that holds an extruded particulate detergent composition, positioning the cap to hold a quantity of the extruded particulate detergent composition, dispensing a quantity of an extruded particulate detergent composition from the container into a cavity in the cap, and pouring the extruded particulate detergent composition from the cap into a receptacle used for washing.

Turning now to the figures, FIG. 1 shows a product containing a transparent container and a solid state detergent composition, according to an example of the principles described herein. Such a product may include a solid state detergent (102), which may be held inside a container (104). The container (104) may be transparent. The container may include a main body portion, and an engagement portion (106), such that the engagement portion engages a lid or cap (108).

Products according to the present specification may include a solid state detergent (102). This may be provided in the form of a powder, granules, particles, pearls, or any other solid state. Such a solid state detergent (102) may be able to dissolve readily upon contact with water.

The ability to dissolve readily upon contact with water may be quantified, and referred to as the "dispensability in water." The dispensability in water may be measured by mixing 8 grams of a solid material with 1 liter (L) of water, wherein the water begins the test procedure at a temperature 30° Celsius (C). The mixture is stirred using a magnetic stir bar at 800 rotations per minute (rpm) for 90 seconds. The liquid is then passed through a sieve of known mass with a mesh size of 0.2 millimeter (mm). The sieve may catch all non-dissolved particles that are larger than 0.2 mm in diameter. The sieve is then dried in a convection oven at 80° C. until the mass is constant. The mass of the particles on the sieve is then determined, and this is used to determine the fraction of the material that was caught by the sieve. The result may be expressed as a percentage residues, and represents the percent of the material that did not dissolve in the contact period with water of 90 seconds.

A solid state detergent (102) according to the present specification may have a dispensability in water of less than or equal to 15 percent (%) residues by weight. For example, a solid state detergent (102) according to the present specification may have a dispensability in water of less than or equal to 10% residues by weight. In another example, a solid state detergent (102) according to the present specification may have a dispensability in water of less than or equal to 8% residues by weight.

Two non-limiting factors that may contribute to the dispensability in water are the particle size and the composition of the solid state detergent (102). As noted above, another contributing factor to determining the optimal particle size may also be the avoidance of small, dust-like particles, or a broad particle size distribution, which may result in separation of constituents due to granular convection.

Solid state detergents (102) according to the present specification may be provided in a particulate form. Solid state detergent (102) particles according to the present specification may have less than or equal to 5% by weight of particles less than 0.2 mm in diameter. For example, solid state detergent (102) particles according to the present specification may have less than or equal to 2% by weight of particles less than 0.2 mm in diameter. Solid state detergent (102) particles according to the present specification may also have less than or equal to 1% by weight of particles less than 0.1 mm in diameter. For example, solid state detergent (102) particles according to the present specification may have less than or equal to 0.5% by weight of particles less than 0.1 mm in diameter. Solid state detergent (102) particles according to the present specification may also have less than or equal to 0.6% by weight of particles less than 0.05 mm in diameter. For example, solid state detergent (102) particles according to the present specification may have less than or equal to 0.3% by weight of particles less than 0.05 mm in diameter. All weights are relative to the total weight of the particulate solid state detergent composition (102).

It may also be advantageous for solid state detergent (102) particles to be small enough to readily dissolve; such considerations may also provide for solid state detergent (102) particles that are free-flowing. Accordingly, solid state detergent (102) particles according to the present specification may have less than or equal to 6% by weight of particles more than 1.6 mm in diameter. For example, solid state detergent (102) particles according to the present specification may have less than or equal to 4% of particles more than 1.6 mm in diameter. Solid state detergent (102) particles according to the present specification may have less than or equal to 2% by weight of particles more than 1.8 mm in diameter. For example, solid state detergent (102) particles according to the present specification may have less than or equal to 1% by weight of particles more than 1.8 mm in diameter. Solid state detergent (102) particles according to the present specification may have less than or equal to 0.5% by weight of particles more than 2.0 mm in diameter. For example, solid state detergent (102) particles according to the present specification may have less than or equal to 0.3% by weight of particles more than 2.0 mm in diameter. All weights are relative to the total weight of the particulate solid state detergent composition (102). A solid state detergent composition (102) according to the present specification may thus have relatively homogenous distribution of particle sizes. For example, a solid state detergent composition (102) according to the present specification may include at least 80% by weight, for example at least 90% by weight, and in another example at least 95% by weight, of particles with a size between 0.4 and 1.6 millimeters (mm). In a further example, a solid state detergent composition (102) according to the present specification may include at least 90% by weight, for example at least 95% by weight of particles with a size between 0.4 mm and 2.0 mm. In a still further example, a solid state detergent composition (102) according to the present specification may include at least 90% by weight, for example at least 95% by weight, in particular at least 97% by weight of particles with a size between 0.1 mm and 1.8 mm.

A solid state detergent composition (102) according to the present specification may be a variety of colors. For example, a solid state detergent composition (102) according to the present specification may be white, off-white, blue, green, or any suitable color. It is also possible for the solid state detergent composition (102) according to the present specification to contain particles of more than one color. For example, a fraction of the particles may be a different color from the remainder of the particles. Such particles of a different color may be referred to as speckles. For example, a solid state detergent composition (102) according to the present specification may be white with blue speckles. In another example, a solid state detergent composition (102) according to the present specification may be white with green speckles. In a further example, a solid state detergent composition (102) according to the present specification may be green or blue with white speckles.

Bulk density may also be a factor in the production cost and packaging cost of solid state detergent compositions (102). Bulk density may be measured as the mass per unit of volume. Measurements of bulk density include any air or the like that may be present in the spaces between solid matter. Accordingly, bulk density may be a function of both particle size and particle density. A solid state detergent composition (102) according to the present specification may have a bulk density of greater than or equal to 650 grams per liter (g/L), for example greater than or equal to 700 g/L, or greater than or equal to 750 g/L.

A solid state detergent composition (102) according to the present specification may include a number of surfactants. Such surfactants may be anionic, nonionic, cationic, amphoteric or zwitterionic.

The anionic surfactants used in acid form may be one or more substances from the group of carboxylic acids, sulfuric half-esters and sulfonic acids, for example from the group of fatty acids, fatty alkylsulfuric acids and alkylarylsulfonic acids. In order to have adequate surface-active properties, said compounds may have relatively long-chain hydrocarbon radicals, i.e. at least 6 atoms in the alkyl or alkenyl radical. The carbon chain distributions of the anionic surfactants may be in the range from 6 to 40, for example from 8 to 30 and in particular from 12 to 22, carbon atoms. In some examples, solid state detergents (102) according to the present specification are characterized in that one or more substances from the group of carboxylic acids, sulfuric half-esters and sulfonic acids, for example from the group of fatty acids, fatty alkylsulfuric acids and alkylarylsulfonic acids, are used as anionic surfactant in acid form. These are described below.

Carboxylic acids have been used in the form of their alkali metal salts as soaps in detergents and cleaners, and may be obtained from natural fats and oils by hydrolysis. In some examples, water may be used for the cleavage, which cleaves the fats into glycerol and the free fatty acids. Processes used include, for example, autoclave cleavage or continuous high-pressure cleavage. Carboxylic acids which can be used for the purposes of the present specification as anionic surfactants are, for example, hexanoic acid (caproic acid), heptanoic acid (enanthic acid), octanoic acid (caprylic acid), nonanoic acid (pelargonic acid), decanoic acid (capric acid), undecanoic acid, etc. For example, solid state detergents (102) according to the present specification may use fatty acids such as dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), hexacosanoic acid (cerotic acid), triacotanoic acid (melissic acid), and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12,15c-octadecatrienoic acid (linolenic acid). It also possible to not use the pure species, but technical-grade mixtures of the individual acids, as are accessible from fat cleavage. Such mixtures are, for example, coconut oil fatty acid (about 6% by weight of $C_8$, 6% by weight of $C_{10}$, 48% by weight of $C_{12}$, 18% by weight of $C_{14}$, 10% by weight of $C_{16}$, 2% by weight of $C_{18}$, 8% by weight of $C_{18'}$, 1% by weight of $C_{18''}$), palm kernel oil fatty acid (about 4% by weight of $C_8$, 5% by weight of $C_{10}$, 50% by weight of $C_{12}$, 15% by weight of $C_{14}$, 7% by weight of $C_{16}$, 2% by weight of $C_{18}$, 15% by weight of $C_{18'}$, 1% by weight of $C_{18''}$), tallow fatty acid (about 3% by weight of $C_{14}$, 26% by weight of $C_{16}$, 2% by weight of $C_{16'}$, 2% by weight of $C_{17}$, 17% by weight of $C_{18}$, 44% by weight of $C_{18'}$, 3% by weight of $C_{18'}$, 1% by weight of $C_{18'''}$), hydrogenated tallow fatty acid (about 2% by weight of $C_{14}$, 28% by weight of $C_{16}$, 2% by weight of $C_{17}$, 63% by weight of $C_{18}$, 1% by weight of $C_{18''}$), technical-grade oleic acid (about 1% by weight of $C_{12}$, 3% by weight of $C_{14}$, 5% by weight of $C_{16}$, 6% by weight of $C_{16'}$, 1% by weight of $C_{17}$, 2% by weight of $C_{18}$, 17% by weight of $C_{18'}$, 10% by weight of $C_{18''}$, 0.5% by weight of $C_{18'''}$), technical-grade palmitic/stearic acid (about 1% by weight of $C_{12}$, 2% by weight of $C_{14}$, 45% by weight of $C_{16}$, 2% by weight of $C_{17}$, 47% by weight of $C_{18}$, 1% by weight of $C_{18'}$), and soybean oil fatty acid (about 2% by weight of $C_{14}$, 15% by weight of $C_{16}$, 5% by weight of $C_{18}$, 25% by weight of $C_{18'}$, 45% by weight of $C_{18''}$, 7% by weight of $C_{18'''}$).

Sulfuric half-esters of longer-chain alcohols are likewise anionic surfactants in their acid form, and can be used as anionic surfactants in a solid state detergent (102) according to the present specification. Alkali metal salts, in particular sodium salts of fatty alcohol sulfates, are accessible from fatty alcohols, which are reacted with sulfuric acid, chlorosulfonic acid, amidosulfonic acid or sulfur trioxide to give alkylsulfuric acids, and are subsequently neutralized. Fatty alcohols may be obtained from fatty acids or fatty acid mixtures by high-pressure hydrogenation of fatty acid methyl esters. Producing fatty alkylsulfuric acids may include the sulfation of the alcohols with $SO_3$/air mixtures in special cascade, falling-film or tube-bundle reactors.

A further class of anionic surfactant acids which can be used according to the present specification are the alkyl ether sulfuric acids, whose salts, the alkyl ether sulfates, are characterized by higher solubility in water and lower sensitivity toward water hardness (less difference in solubility between the anionic form and the calcium ($Ca^{2+}$) and/or magnesium ($Mg^{2+}$) salts). Alkyl ether sulfuric acids are synthesized like the alkylsulfuric acids from fatty alcohols, which are reacted with alkylene oxide to give the corresponding fatty alcohol alkoxylates. Non-limiting examples of suitable alkylene oxides include ethylene oxide and propylene oxide. The subsequent sulfonation with gaseous sulfur trioxide in short-path sulfation reactors produces yields greater than 98% of the corresponding alkyl ether sulfuric acids.

Alkanesulfonic acids and olefinsulfonic acids may also be used as anionic surfactants in acid form for the purposes of the present specification. Alkanesulfonic acids can contain a sulfonic acid group terminally bonded (primary alkanesulfonic acids) or along the carbon chain (secondary alkanesulfonic acids). These are prepared by sulfochlorination or sulfoxidation of linear hydrocarbons. During the sulfochlorination, n-paraffins are reacted with sulfur dioxide and chlorine with irradiation by UV light to give the corresponding sulfochlorides which, upon hydrolysis with alkalis, produce the alkanesulfonates, or upon reaction with water, produce the alkanesulfonic acids.

Another process for producing alkanesulfonic acids may be sulfoxidation, in which n-paraffins may be reacted with sulfur dioxide and oxygen under irradiation with UV light. In this free-radical reaction, successive alkylsulfonyl radicals may be formed, which may further react with oxygen to give the alkylpersulfonyl radicals. The reaction with unreacted paraffin produces an alkyl radical and an alkylpersulfonic acid, which decomposes into an alkylperoxysulfonyl radical and a hydroxyl radical. The reaction of the two radicals with unreacted paraffin produces the alkylsulfonic acids or water, which reacts with alkylpersulfonic acid and sulfur dioxide to give sulfuric acid. The reaction may be terminated prior to total conversion in order to optimize the yield of the two end products alkylsulfonic acid and sulfuric acid.

Olefinsulfonates may be produced by reacting α-olefins with sulfur trioxide. In this process, zwitterions may form as an intermediate, which cyclize to give so-called sultones. Under suitable conditions (alkaline or acidic hydrolysis), these sultones may react to give hydroxyalkanesulfonic acids or alkenesulfonic acids, both of which can likewise be used as anionic surfactant acids.

Alkylbenzenesulfonates may be high-performance anionic surfactants. One example of an alkylbenzenesulfonate surfactant is tetrapropylenebenzenesulfonates (TPS). However, TPS surfactants may present ecological concerns. Accordingly, linear alkylbenzenesulfonates, or alkyl-benzenesulfonates, may be used as an anionic surfactant according to the present specification, and may be denoted by the abbreviation ABS. Alkylbenzenesulfonates (ABS) may be high-performance surfactants, and may offer an improved ecological profile over TPS surfactants.

Linear alkylbenzenesulfonates may be prepared from linear alkylbenzenes, which in turn may be accessible from linear olefins. For this, petroleum fractions are separated into the n-paraffins of the desired purity using molecular sieves and dehydrogenated to give the n-olefins, resulting in both α- and i-olefins. The resulting olefins are then reacted in the presence of acidic catalysts with benzene to give alkylbenzenes. The choice of catalyst may have an influence on the isomer distribution of the resulting linear alkylbenzenes: when aluminum trichloride is used, the content of the 2-phenyl isomers in the mixture with the 3-, 4-, 5- and other isomers may be about 30% by weight; if on the other hand hydrogen fluoride is used as catalyst, the content of 2-phenyl isomer can drop to about 20% by weight. Finally, the sulfonation of the linear alkylbenzenes may take place with oleum, sulfuric acid or gaseous sulfur trioxide, the latter being by far the most commercially significant. For the sulfonation, special film or tube-bundle reactors may be used which produce, as product, a 97% strength by weight alkylbenzenesulfonic acid (ABSA), which may be used as an anionic surfactant acid for the purposes of the present specification.

Through the choice of the neutralizing agent it is possible to obtain a very wide variety of salts, i.e. alkylbenzenesulfonates, from ABSA. In some examples an alkali metal salt may be produced and used and, among these, specifically the sodium salts of the ABSA. These can be described by the general formula I:

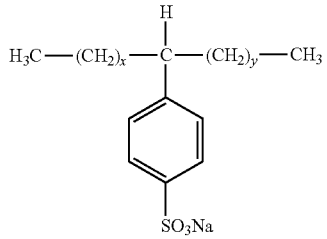

(I)

in which the sum of x and y is between 5 and 13. Solid state detergents (102) according to the present specification may include as an anionic surfactant, for example, $C_{8-16}$-, in particular $C_{9-13}$-alkylbenzenesulfonic acids. For the purposes of the present specification, it is also possible to use $C_{8-16}$-, for example $C_{9-13}$-alkylbenzenesulfonic acids which are derived from alkylbenzenes which have a tetralin content below 5% by weight, based on the alkylbenzene. It is also possible to use alkylbenzenesulfonic acids whose alkylbenzenes have been produced by the HF process, so that the $C_{8-16}$-, for example $C_{9-13}$-alkylbenzenesulfonic acids used have a content of 2-phenyl isomer below 22% by weight, based on the alkylbenzenesulfonic acid.

The abovementioned anionic surfactants may be used on their own or in a mixture with one another in a solid state detergent (102) according to the present specification. The abovementioned anionic surfactants may also be used in either their acid form or as neutralized salts in a solid state detergent (102) according to the present specification. Such neutralized salts may include the anionic surfactant molecule with a cation provided by, for example, an alkali metal or alkaline earth metal. For example, sodium, potassium, lithium, calcium and magnesium cations may be used.

Anionic surfactants may be provided in a solid state detergent (102) according to the present specification in amounts of from 10% to 40% by weight. For example, a number of anionic surfactants may be included in a solid state detergent (102) according to the present specification in amounts of from 15% to 23% by weight, such as from 15% to 21% by weight. In each case, weight percentages are relative to the total weight of the solid state detergent composition (102).

A solid-state detergent composition (102) according to the present specification may also include nonionic surfactants. Such nonionic surfactants may be, for example, alkoxylated alcohols, alkyl glycosides, alkoxylated fatty acid alkyl esters, amine oxides, fatty acid alkanolamides and polyhydroxy fatty acid amides. These are described below.

Nonionic surfactants according to the present specification may include alkoxylated, for example ethoxylated, alcohols. For example, alkoxylated primary or secondary alcohols having from 8 to 18 carbon atoms and on average 1 to 12 mol of ethylene oxide (EO) per mole of alcohol may be used. In one example, the alcohol radical may be linear; in another example, the alcohol radical may be methyl-branched in the 2 position; in a further example, the alcohol radical may contain linear and methyl-branched radicals in a mixture, as may be present in oxo alcohol radicals. According to one example, alcohol ethoxylates with linear radicals from alcohols of natural origin having 12 to 18 carbon atoms, e.g. from coconut, palm, tallow fatty or oleyl alcohol, and on average 2 to 8 EO per mole of alcohol may be used. Examples of such ethoxylated alcohols include, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures thereof, such as mixtures of $C_{12-14}$-alcohol with 3 EO and $C_{12-18}$-alcohol with 5 EO. The given degrees of ethoxylation represent statistical average values which may be either an integer or a fraction for a specific product. In one example, alcohol ethoxylates that have a narrowed homolog distribution (narrow range ethoxylates, NRE) may be used as a nonionic surfactant in a solid state detergent (102) according to the present specification. In addition to these nonionic surfactants, it is also possible to use fatty alcohols with more than 12 EO. Examples thereof are tallow fatty alcohol with 14 EO, 25 EO, 30 EO or 40 EO.

As further nonionic surfactants, it is also possible to use alkyl glycosides of general formula $RO(G)_x$, in which R is (1) a primary straight-chain or methyl-branched, which may be, for example, methyl-branched in the 2 position, or (2) an aliphatic radical having 8 to 22, for example 12 to 18, carbon atoms. G is the symbol which stands for a glycose unit having 5 or 6 carbon atoms, for example glucose. The degree of oligomerization may be denoted by x, which gives the distribution of monoglycosides and oligoglycosides, x may be any number between 1 and 10; for example, x ranges 1.2 to 1.4.

A further class of nonionic surfactants, which are used either as the sole nonionic surfactant or in combination with other nonionic surfactants, are alkoxylated, for example ethoxylated or ethoxylated and propoxylated fatty acid alkyl esters. Such alkoxylated fatty acid alkyl esters may have, for example, from 1 to 4 carbon atoms in each alkoxy unit.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable. These nonionic surfactants may be used either as the sole nonionic surfactant, or in combination with another nonionic surfactant, for example alkoxylated fatty alcohols.

Further suitable surfactants are polyhydroxy fatty acid amides of formula (II), (II)

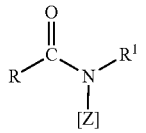

in which RCO may be an aliphatic acyl radical having from 6 to 22 carbon atoms, $R^1$ may be hydrogen, an alkyl or hydroxyalkyl radical having from 1 to 4 carbon atoms and [Z] may be a linear or branched polyhydroxyalkyl radical having from 3 to 10 carbon atoms and from 3 to 10 hydroxyl groups. The polyhydroxy fatty acid amides are substances which can be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of formula (III), (III)

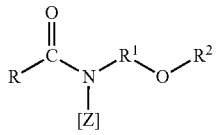

in which R may be a linear or branched alkyl or alkenyl radical having from 7 to 12 carbon atoms, $R^1$ may be a linear, branched or cyclic alkyl radical or an aryl radical having from 2 to 8 carbon atoms and $R^2$ may be a linear, branched or cyclic alkyl radical or an aryl radical or an oxy-alkyl radical having from 1 to 8 carbon atoms, for example $C_{1-4}$-alkyl or phenyl radicals, and [Z] may be a linear polyhydroxyalkyl radical whose alkyl chain is substituted by at least two hydroxyl groups, or alkoxylated, for example ethoxylated or propoxylated, derivatives of this radical.

[Z] may be obtained by reductive amination of a reduced sugar, for example glucose, fructose, maltose, lactose, galactose, mannose or xylose. The N-alkoxy- or N-aryloxy-substituted compounds can be converted to the desired polyhydroxy fatty acid amides by reaction with fatty acid methyl esters in the presence of an alkoxide catalyst.

The compositions produced according to the present specification may include a nonionic surfactant that has a melting point above room temperature. For example, a solid state detergent composition (102) according to the present specification may include nonionic surfactant(s) with a melting point above 20° C., for example above 25° C., in a further example between 25° C. and 60° C. and in a still further example between 26.6 C. and 43.3° C.

Suitable nonionic surfactants that have melting or softening points in the stated temperature range are, for example, weakly-foaming nonionic surfactants, which may be solid or highly viscous at room temperature. If nonionic surfactants which are highly viscous at room temperature are used, then these nonionic surfactants may have a viscosity above 20 Pa·s, for example, above 35 Pa·s and in particular above 40 Pa·s. Nonionic surfactants which have wax-like consistency at room temperature may also be used.

Nonionic surfactants which are solid at room temperature may also be used, and may include the group of alkoxylated nonionic surfactants, in particular the ethoxylated primary alcohols and mixtures of these surfactants with structurally complicated surfactants, such as polyoxypropylene/polyoxyethylene/polyoxypropylene (PO/EO/PO) surfactants. Such (PO/EO/PO) nonionic surfactants are characterized, moreover, by good foam control.

In one example of a solid state detergent (102) according to the present specification, the nonionic surfactant with a melting point above room temperature is an ethoxylated nonionic surfactant which has resulted from the reaction of a monohydroxyalkanol or alkylphenol having from 6 to 20 carbon atoms with at least 12 mol, for example at least 15 mol, in particular at least 20 mol, of ethylene oxide per mole of alcohol or alkylphenol.

Another example of a solid-state detergent (102) according to the present specification may use, as the nonionic surfactant, a surfactant which is solid at room temperature and obtained from a straight-chain fatty alcohol having from 16 to 20 carbon atoms ($C_{16-20}$-alcohol), for example a $C_{18}$-alcohol and at least 12 mol, for example at least 15 mol and in particular at least 20 mol, of ethylene oxide. Examples of such nonionic surfactants may include the so-called "narrow range ethoxylates" (see above).

Accordingly, a further example of a solid-state detergent composition (102) according to the present specification includes ethoxylated nonionic surfactant(s) which has/have been obtained from $C_{6-20}$-monohydroxyalkanols or $C_{6-20}$-alkylphenols or $C_{6-20}$-fatty alcohols and more than 12 mol, for example more than 15 mol and in particular more than 20 mol, of ethylene oxide per mole of alcohol.

The nonionic surfactant(s) may additionally has/have propylene oxide (PO) units in the molecule. In one example, such PO units may constitute up to 25% by weight, for example up to 20% by weight, and in particular up to 15% by weight, of the total molar mass of the nonionic surfactant. Examples of such nonionic surfactants are ethoxylated monohydroxyalkanols or alkylphenols which additionally have polyoxyethylene-polyoxypropylene block copolymer units. The alcohol or alkylphenol moiety of such nonionic surfactant molecules may constitute more than 30% by weight, for example more that 50% by weight, and in particular more than 70% by weight, of the total molar mass of such nonionic surfactants.

Further nonionic surfactants with melting points above room temperature that may be used in a solid state detergent composition (102) according to the present specification include from 40% to 70% of a polyoxypropylene/polyoxyethylene/polyoxypropylene block polymer blend. One example of such a polyoxypropylene/polyoxyethylene/polyoxypropylene block polymer blend may include 75% by weight of an inverse block copolymer of polyoxyethylene and polyoxypropylene which contains 17 mol of ethylene oxide and 44 mol of propylene oxide and 25% by weight of a block copolymer of polyoxyethylene and polyoxypropylene; polymerization of such a block polymer may be initiated with trimethylolpropane, and may include 24 mol of ethylene oxide and 99 mol of propylene oxide per mole of trimethylolpropane.

Exemplary nonionic surfactants which can be used are available, for example, under the name Poly Tergent® SLF-18 from Olin Chemicals. A further example of a solid state detergent (102) according to the present specification includes nonionic surfactants of the formula $$R^1O[CH_2CH(CH_3)O]_x[CH_2CH_2O]_y[CH_2CH(OH)R^2]$$

in which $R^1$ may be a linear or branched aliphatic hydrocarbon radical having from 4 to 18 carbon atoms or mixtures thereof, $R^2$ may be a linear or branched hydrocarbon radical having from 2 to 26 carbon atoms or mixtures thereof, and x may have a value between 0.5 and 1.5 and y may have a value of at least 15. The values of x and y may be a statistical average, and may be either an integer or a fraction.

Further nonionic surfactants which may be used in a solid state detergent composition (102) according to the present specification are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ may be linear or branched, saturated or unsaturated, aliphatic or aromatic hydrocarbon radicals having from 1 to 30 carbon atoms, $R^3$ may be hydrogen or a methyl, ethyl, n-propyl, isopropyl, n-butyl, 2-butyl or 2-methyl-2-butyl radical, x may assume a value between 1 and 30, k and j may assume values between 1 and 12, for example between 1 and 5. If the value of x is greater than or equal to 2, each $R^3$ in the above formula may be either the same or different. In one example, $R^1$ and $R^2$ are linear or branched, saturated or unsaturated, aliphatic or aromatic hydrocarbon radicals having from 6 to 22 carbon atoms, in particular from 8 to 18 carbon atoms. According to another example, the radical $R^3$ may be provided by H, —$CH_3$ or —$CH_2CH_3$. In one example, x may assume a value in the range from 1 to 20, in particular from 6 to 15.

As described above, each $R^3$ in the above formula may be either the same or different if x is greater than or equal to 2. As a result, the alkylene oxide unit in the square brackets may be variable. If, for example, x is 3, the radical $R^3$ may be chosen in order to form ethylene oxide ($R^3$=H) or propylene oxide ($R^3$=$CH_3$) units, which can be added in any order, for example (EO)(PO)(EO), (EO)(EO)(PO), (EO)(EO)(EO), (PO)(EO)(PO), (PO)(PO)(EO) and (PO)(PO)(PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Exemplary terminally capped poly(oxyalkylated) alcohols of the above formula may have values of k=1 and j=1, so that the above formula is simplified to $$R^1O[CH_2CH(R^3)O]_xCH_2CH(OH)CH_2OR^2.$$

In the last-mentioned formula, $R^1$, $R^2$ and $R^3$ are as defined above and x may represent a number from 1 to 30, for example from 1 to 20 and in particular from 6 to 18. Suitable surfactants include those in which the radicals $R^1$ and $R^2$ have 9 to 14 carbon atoms, $R^3$ is H and x assumes values from 6 to 15.

Nonionic surfactants may be provided in a solid state detergent (102) according to the present specification in amounts of from 1% to 30% by weight. For example, a number of nonionic surfactants may be included in a solid state detergent (102) according to the present specification in amounts of from 3% to 10% by weight. In each case, weight percentages are relative to the total weight of the solid state detergent composition (102).

It is also possible to use cationic and/or amphoteric surfactants in a solid state detergent composition (102) according to the present specification. In some examples, such surfactants may be used in amounts below 10% by weight, for example below 5% by weight, such as from 0.01 to 2.5% by weight, in each case based on the total weight of the composition. The compositions produced according to the present specification can thus also include cationic and/or amphoteric surfactants as surfactant component. For the purposes of the present specification, the term amphoteric surfactants is meant to also include zwitterionic surfactants. Examples of such zwitterionic surfactants include surfactants with a quaternary ammonium and an anionic group selected from carboxylic acid (betaines), sulfonate (sultaines), and phosphonate.

As cationic active substances, the solid state detergent compositions (102) according to the present specification can, for example, include cationic compounds of formulae IV, V or VI:

(IV)

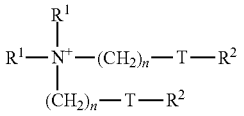

(V)

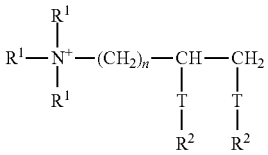

(VI)

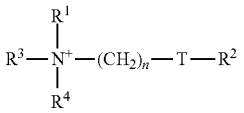

in which each group $R^1$ is chosen, independently of the others, from $C_{1-6}$-alkyl, -alkenyl or -hydroxyalkyl groups; each group $R^2$ is chosen, independently of the others, from $C_{8-28}$-alkyl or -alkenyl groups; $R^3$=$R^1$ or $(CH_2)_n$-T-$R^2$; $R^4$=$R^1$ or $R^2$ or $(CH_2)_n$-T-$R^2$; T=—$CH_2$—, —O—CO— or —CO—O— and n is an integer from 0 to 5.

A solid state detergent composition (102) according to the present specification may also include additional, non-surfactant components. Such components may include builders, bleaching agents, bleach activators, optical brighteners, anti-caking agents, etc. Each of these are described further below.

Builders may be included in a solid state detergent composition (102) according to the present specification. Builders may be compounds which complex with ions that contribute to water hardness, such as, for example, calcium and magnesium ions. Builders may include, for example, alkali metal carbonates, alkali metal sulfates and alkali metal silicates, zeolites and polymers. Further examples of suitable builders also include organic acid salts, such as citric acid. Builders that are salts of acids may be added in either their salt form or their acid form. Optionally, builders that are added in their acid form may be subsequently neutralized.

Examples of builder acids which may be used in a solid state detergent (102) according to the present specification are one or more substances from the group consisting of citric acid, tartaric acid, succinic acid, malonic acid, adipic acid, maleic acid, fumaric acid, oxalic acid, gluconic acid and/or nitrilotriacetic acid, aspartic acid, ethylenediaminetetraacetic acid, aminotrimethylenephosphonic acid, hydroxyethanediphosphonic acid and/or the groups of polyaspartic acids, polyacrylic and polymethacrylic acids, and copolymers thereof. These substances are described below.

Citric acid (2-hydroxy-1,2,3-propanetricarboxylic acid) has, as monohydrate, a density of 1.542 and a melting point of 100° C., in anhydrous form a density of 1.665 and a melting point of 153° C. Citric acid is very readily soluble in water with an acidic taste and acidic reaction, is likewise readily soluble in alcohol, but is sparingly soluble in ether and insoluble in benzene and chloroform. Upon heating to above 175° C., decomposition takes place with the formation of methylmaleic anhydride. Citric acid is an intermediate of the citric acid cycle is obtained from lemon juice by precipitation with milk of lime as calcium citrate, which is decomposed by sulfuric acid into calcium sulfate and free citric acid. In some examples, more than 90% of citric acid may be obtained by aerobic fermentation.

Tartaric acid (2,3-dihydroxybutanedioic acid, 2,3-dihydroxysuccinic acid, tetraric acid, tartar acid) occurs in 3 stereoisomeric forms: the L-(+) form [so-called natural tartaric acid, (2R,3R) form], the D-(−) form [(2S,3S) form] and the meso form [eryuthraric acid]. Tartaric acid is a strong acid, readily soluble in water (the L form more so than the racemate), methanol, ethanol, 1-propanol, glycerol, and is insoluble in chloroform. The L form occurs in many plants and fruits, in free form and as potassium, calcium or magnesium salts, e.g. in grape juice partially as free tartaric acid, partially as potassium hydrogentartrate, which settles out as tartar together with calcium tartrate after the fermentation of wine. To prepare tartaric acid, tartar is, for example, converted with calcium chloride or calcium hydroxide into calcium tartrate. Sulfuric acid is used to release tartaric acid and gypsum from calcium tartarate; tartaric acid is thus a by-product of wine production. DL- and meso-tartaric acid may be obtained in the oxidation of fumaric acid or maleic anhydride with hydrogen peroxide, potassium permanganate, peracids, in the presence of tungstic acid.

Succinic acid (butanedioic acid), HOOC—$CH_2$—$CH_2$—COOH, has a density of 1.56, a melting point of 185-187° C. and a boiling point of 235° C. Succinic acid is very readily soluble in boiling water, readily soluble in alcohols and acetone, but insoluble in benzene, carbon tetrachloride and petroleum ether. The preparation of succinic acid takes place by hydrogenation of maleic acid, oxidation of 1,4-butanediol, oxo synthesis of acetylene and by fermentation from glucose.

Malonic acid (propanedioic acid), HOOC—$CH_2$—COOH, has a density of 1.619, and a melting point of 135° C.; acetic acid forms somewhat above this temperature with the elimination of carbon dioxide. Malonic acid is very readily soluble in water and pyridine, soluble in alcohol and ether, and insoluble in benzene; in aqueous solution, it decomposes above about 70° C., producing acetic acid and carbon dioxide. Malonic acid is prepared, for example, by reacting chloroacetic acid with NaCN and subsequent hydrolysis of the resulting cyanoacetic acid.

Adipic acid (hexanedioic acid), HOOC—$(CH_2)_4$—COOH, has a melting point of 153° C. and a boiling point of 265° C. (at 13.3 kPa). It is not very soluble in water. Adipic acid may be obtained by the oxidative cleavage of cyclohexane. Adipic acid is prepared here in two stages via the intermediate cyclohexanol/cyclohexanone.

Maleic acid ((Z)-2-butenedioic acid) has a density of 1.590, a melting point of 130-131° C. (from alcohol and benzene), or of 138-139° C. (from water), is readily soluble in water and alcohol, and is less readily soluble in acetone, ether and glacial acetic acid; maleic acid is virtually insoluble in benzene. Maleic acid is stereoisomeric with fumaric acid, into which it can be rearranged thermally or catalytically. In contrast to fumaric acid, it is not a naturally occurring compound and is generally prepared by adding water onto maleic anhydride.

Fumaric acid ((E)- or trans-butenedioic acid), has a density of 1.625, is moderately soluble in boiling water and alcohol, and is barely soluble in most organic solvents. Fumaric acid is a type of fruit acid and occurs in a number of plants, e.g. in common fumitory (Fumaric officinalis), in Icelandic moss, and in fungi and lichens. In the citric acid cycle, it arises as intermediate during the dehydrogenation of succinic acid. Fumaric acid is stereoisomeric with maleic acid, from which it can be prepared by isomerization; preparation also takes place by fermentation from sugar or starch.

Oxalic acid (ethanedioic acid, sorrel acid), HOOC—COOH, has a density of 1.653, a melting point of 101.5° C. and a boiling point of 150° C. Oxalic acid dissolves very readily in water (120 g/l) and in ethanol, but less so in ether and not at all in benzene, chloroform, or petroleum ether. Oxalic acid may be found in common wood sorrel as the acidic potassium salt, in sorrel and rhubarb. Oxalic acid may be prepared by acidic hydrolysis of dicyanogen; oxalic acid may also be prepared by oxidation of carbohydrates, glycols, olefins, acetylenes or acetaldehyde with concentrated nitric acid in the presence of catalysts or by alkali melts of sodium formate.

Nitrilotriacetic acid (abbreviation NTA), $N(CH_2—COOH)_3$, has a melting point of 242° C. (with decomposition), is barely soluble in water, and readily soluble in alcohol. The sodium salts of NTA are prepared by cyanomethylation of ammonia with formaldehyde and sodium cyanide and subsequent hydrolysis of the intermediate tris (cyanomethyl)amine (alkaline process), which can also be obtained by reacting hexamethylenetriamine with hydrogen cyanide in sulfuric acid (acidic process). The sodium salts of NTA are readily biodegradable complexing agents (chelating agents) from the substance class of aminocarboxylates, which are used in some countries, such as Canada and Switzerland, as a constituent of builder systems in detergents.

Aspartic acid (2-aminosuccinic acid, abbreviation of the L form is Asp or D), has a density of 1.66, melts at 270° C. (with decomposition) and is sparingly soluble in water, and insoluble in alcohols. The nonessential amino acid L-aspartic acid is found, for example, in zein in an amount of 1.8% by weight, in the casein of cows' milk in an amount of 1.4% by weight, in equine hemoglobin in an amount of 4.4% by weight, and in wool keratin in an amount of 5-10%. It is accessible synthetically from maleic acid or fumaric acid and ammonia under pressure and by subsequent racemate resolution or—on a scale of about 1000 tons per year—enzymatically with aspartase (L-aspartate ammonia lyase, EC 4.3.1.1).

Polyaspartic acids are polypeptides of aspartic acid. Polyaspartic acid sequences are found naturally in mussel or snail shells, where they regulate shell growth. The product may be prepared from maleic anhydride by ammonolysis and polymerization with subsequent basic hydrolysis (Bayer) and contains both α and also β bonds. Polyaspartic acids may be excellent dispersants for solids and particularly effective stabilizers for hardness formers in water. As an excellent sequestering agent, polyaspartic acid may be suitable for removing and preventing encrustations. Polyaspartic acid may already be used in ecologically high-value detergents.

Ethylenediaminetetraacetic acid (ethylenedinitrilotetraacetic acid, EDTA), decomposes above 150° C. with loss of $CO_2$ and is sparingly soluble in water. Ethylenediaminetetraacetic acid and its alkali metal and alkaline earth metal salts (the so-called edetates) react-similarly to ethylenediamine—with many metal ions to form nonionized chelates, which are used in order to dissolve or eliminate troublesome metal salt deposits; ethylenediaminetetraacetic acid is prepared from ethylenediamine and chloroacetic acid or by acidic or alkaline cyanomethylation of ethylenediamine with formaldehyde and hydrocyanic acid.

A further substance class of the builder acids are the phosphonic acids. In particular, these are hydroxyalkane- or aminoalkanephosphonic acids. Among the hydroxyalkanephosphonic acids, 1-hydroxyethane-1,1-diphosphonic acid (HEDP) is of particular importance. It may be neutralized to give a sodium salt; the disodium salt being neutral and the tetrasodium salt being alkaline (pH 9).

Further suitable builder acids are, for example, the polymeric polycarboxylic acids, these are, for example, the polyacrylic acid or the polymethacrylic acid, for example those with a relative molecular mass of from 500 to 70,000 g/mol.

For the purposes of the present specification, the molar masses quoted for polymeric polycarboxylic acids are weight-average molar masses $M_w$ of the particular acid form, which have been determined in principle by means of gel permeation chromatography (GPC), using a UV detector. The measurement was made against an external polyacrylic acid standard which, due to its structural similarity to the investigated polymers, produces realistic molecular weight values. This data differs significantly from the molecular weight data in which polystyrenesulfonic acids are used as standard. The molar masses measured against polystyrenesulfonic acids are generally considerably higher than the molar masses quoted in the present specification.

Suitable polymers are, in particular, polyacrylic acids which may have a molecular mass of from 2,000 to 20,000 g/mol. Due to the superior solubility of their neutralized salts, one example of a solid state detergent composition (102) according to the present specification uses, as a builder acid, the short-chain polyacrylic acids, which have molar masses of from 2,000 to 10,000 g/mol, for example from 3,000 to 5,000 g/mol.

Also suitable are copolymeric polycarboxylic acids, in particular those of acrylic acid with methacrylic acid and of acrylic acid or methacrylic acid with maleic acid. In one example, copolymers of acrylic acid with maleic acid that contain from 50% to 90% by weight of acrylic acid and from 50% to 10% by weight of maleic acid may be used. In another example, the relative molecular mass of copolymeric polycarboxylic acids, based on free acids, may range from 2,000 to 70,000 g/mol, for example from 20,000 to 50,000 g/mol, and in particular from 30,000 to 40,000 g/mol.

Further suitable builder acids are ethylenediaminetetra (methylenephosphonic acid) (EDTMP), diethylenetriaminepenta(methylenephosphonic acid) (DTPMP), 1-hydroxyethane-1,1-diphosphonic acid (HEDP), 2-phosphonobutane-1,2,4-tricarboxylic acid (PBTC), hexamethylenediaminetetra(methylenephosphonic acid) (HDTMP), diethylenetriaminepentaacetic acid (DTPA), propylenediaminetetraacetic acid (PDTA), methyl-glycinediacetic acid (MGDA), iminodisuccinic acid (IDS), ethylenediamine-N,N'-disuccinic acid (Octaquest E).

Silicates may also provide a suitable builder. Suitable crystalline, layered sodium silicates possess the general formula $NaMSi_xO_{2x+1}.yH_2O$, where M is sodium or hydrogen, x is a number from 1.9 to 4, y is a number from 0 to 20. Values for x may be a statistical average, and according to one example of a solid state detergent (102) according to the present specification, are 2, 3 or 4. Examples of such crystalline phyllosilicates of the formula indicated are those in which M is sodium and x adopts the value 2 or 3. In particular, both β- and δ-sodium disilicates, $Na_2Si_2O_5.yH_2O$, may be used. According to one example, β-sodium disilicate is used.

It is also possible to use amorphous sodium silicates having an $Na_2O:SiO_2$ modulus of from 1:2 to 1:3.3, for example from 1:2 to 1:2.8, and in particular from 1:2 to 1:2.6, which are dissolution-retarded and have secondary washing properties. The retardation of dissolution relative to other amorphous sodium silicates may have been brought about in a variety of ways—for example, by surface treatment, compounding, compacting, or overdrying. In the context of the present specification, the term "amorphous" also embraces "X-ray-amorphous". This means that in X-ray diffraction experiments, the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield blurred or even sharp diffraction maxima. The interpretation of this is that the products may have microcrystalline regions with a size of from 10 to several hundred nm, for example up to a maximum of 50 nm and in particular up to a maximum of 20 nm. Exemplary such silicates include compacted amorphous silicates, compounded amorphous silicates, and overdried X-ray-amorphous silicates.

Zeolites may also be used as a builder in a solid state detergent composition (102) according to the present specification. For example, finely crystalline, synthetic zeolite may be used, which may contain bound water. Examples of such zeolites include zeolite A and/or P. As zeolite P, Zeolite MAP® (commercial product from Crosfield) may be used. Also suitable, however, are zeolite X and also mixtures of A, X and/or P. Available commercially and suitable for use in the context of the present specification is, for example, a cocrystallizate of zeolite X and zeolite A (approximately 80% by weight zeolite X), which is sold by CONDEA Augusta S.p.A. under the brand name VEGOBOND AX® and may be described by the formula $$n\mathrm{Na_2O}.(1-n)\mathrm{K_2O}.\mathrm{Al_2O_3}.(2-2.5)\mathrm{SiO_2}.(3.5-5.5)\mathrm{H_2O}.$$

Suitable zeolites may have an average particle size of less than 10 μm (volume distribution; measurement method: Coulter counter) and may contain from 18 to 22% by weight, for example from 20 to 22% by weight, of bound water.

Phosphates may also be used as builder substances provided such a use is not to be avoided on ecological grounds. Of particular suitability are the sodium salts of the orthophosphates, the pyrophosphates and, in particular, the tripolyphosphates.

Besides the builders, a solid state detergent composition (102) according to the present specification may also include bleaches, bleach activators, enzymes, silver protectants, dyes and fragrances, etc. In addition, further ingredients may be present, which may, for example, include one or more substances from the group of pH adjusting agents, chelate complexing agents or of film-inhibiting polymers.

Among the compounds which serve as bleaches and liberate $H_2O_2$ in water, sodium perborate tetrahydrate and sodium perborate monohydrate may be suitable for use in a solid state detergent composition (102) according to the present specification. Examples of further bleaches which may be used are sodium percarbonate, peroxypyrophosphates, citrate perhydrates, and $H_2O_2$-supplying peracidic salts or peracids, such as perbenzoates, peroxophthalates, diperazelaic acid, phthaloiminoperacid or diperdodecanedioic acid. A solid state detergent (102) or cleaner according to the present specification can also include bleaches from the group of organic bleaches. Examples of organic bleaches include the diacyl peroxides, such as, for example, dibenzoyl peroxide. Further organic bleaches include the peroxy acids, particular examples being the alkylperoxy acids and the arylperoxy acids. Representative examples include (a) peroxybenzoic acid and its ring-substituted derivatives, such as alkylperoxybenzoic acids, but also peroxy-α-napthoic acid and magnesium monoperphthalate, (b) the aliphatic or substituted aliphatic peroxy acids, such as peroxylauric acid, peroxystearic acid, ε-phthalimido-peroxycaproic acid [phthaloiminoperoxyhexanoic acid (PAP)], o-carboxybenzamidoperoxycaproic acid, N-nonenylamidoperadipic acid and N-nonenylamido-persuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyl-di (6-aminopercaproic acid).

Another type of bleaches which may be used in solid state detergents (102) according to the present specification may also be substances which liberate chlorine or bromine. Suitable materials which liberate chlorine or bromine are, for example, heterocyclic N-bromoamides and N-chloroamides, for example trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Bleach activators may assist the effect of the bleaches. Bleach activators may be compounds which contain one or more N- or O-acyl groups, such as substances from the class of anhydrides, of esters, of imides and of acylated imidazoles or oximes. Examples are tetraacetylethylenediamine TAED, tetraacetylmethylenediamine TAMD and tetraacetylhexylenediamine TAHD, but also pentaacetylglucose PAG, 1,5-diacetyl-2,2-dioxohexahydro-1,3,5-triazine DADHT and isatoic anhydride ISA.

Bleach activators which can be used are compounds which, under perhydrolysis conditions, produce aliphatic peroxocarboxylic acids, for example those having from 1 to 10 carbon atoms, in particular 2 to 4 carbon atoms, and/or optionally substituted perbenzoic acid. Substances which carry O- and/or N-acyl groups of said number of carbon atoms and/or optionally substituted benzoyl groups are suitable. For example, suitable bleach activators include polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- and iso-NOBS), carboxylic anhydrides, in particular phthalic anhydride, acylated polyhydric alcohols, in particular triacetin, ethylene glycol diacetate, 2,5-diacetoxy-2,5-dihydrofuran, n-methyhnorpholinium acetonitrile methylsulfate (MMA), enol esters, acetylated sorbitol and mannitol and mixtures thereof (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam. Hydrophilically substituted acylacetals and acyllactams may also be used. Combinations of conventional bleach activators can also be used.

In addition to the conventional bleach activators, or instead of them, so-called bleach catalysts may also be present in the compositions according to the present specification. These substances are bleach-boosting transition metal salts or transition metal complexes, such as, for example Mn-, Fe-, Co-, Ru- or Mo-salen complexes or -carbonyl complexes. Mn, Fe, Co, Ru, Mo, Ti, V and Cu complexes with N-containing tripod ligands, and Co-, Fe-, Cu- and Ru-ammine complexes can also be used as bleach catalysts.

Exemplary bleach activators include those from the group of polyacylated alkylenediamines, in particular tetraacetylethylenediamine (TAED), N-acylimides, in particular N-nonanoylsuccinimide (NOSI), acylated phenolsulfonates, in particular n-nonanoyl- or isonon-anoyloxybenzenesulfonate (n- or iso-NOBS), n-methylmorpholinium acetonitrile methylsulfate (MMA). Bleach activators may be included in a solid state detergent composition (102) according to the present specification in amounts up to 10% by weight, for example from 0.1% by weight to 8% by weight, such as from 2 to 8% by weight, in particular from 2 to 6% by weight, based on the total composition.

Exemplary bleach-boosting transition metal complexes, in particular with the central atoms Mn, Fe, Co, Cu, Mo, V, Ti and/or Ru, include those chosen from the group of manganese and/or cobalt salts and/or complexes, such as the cobalt (ammine) complexes, the cobalt (acetato) complexes, the cobalt (carbonyl) complexes, the chlorides of cobalt or of manganese, and manganese sulfate. Such bleach-boosting transition metal complexes may be used in catalytic amounts, for example in an amount up to 5% by weight, such as from 0.0025% by weight to 1% by weight and in particular from 0.01% by weight to 0.25% by weight, in each case based on the total composition. However, in special cases, more bleach activator can also be used.

Suitable enzymes in the solid state detergents (102) or cleaners according to the present specification are, in particular, those from classes of hydrolases, such as the proteases, esterases, lipases or lipolytic enzymes, amylases, glycosyl hydrolases and mixtures of said enzymes. All of these hydrolases may contribute to the removal of soilings, such as protein-, grease- or starch-containing stains. For bleaching, it is also possible to use oxidoreductases. Especially suitable enzymatic active ingredients are those obtained from bacterial strains or fungi, such as *Bacillus subtilis, Bacillus licheniformis, Streptomyces griseus, Coprinus cinereus* and *Humicola insolens*, and from genetically modified variants thereof. Proteases include those of the subtilisin type, such as proteases obtained from *Bacillus lentus*. In some examples enzyme mixtures may be used, specific examples of which include: (1) protease and amylase, (2) protease and lipase or lipolytic enzymes, (3) protease, amylase and lipase or lipolytic enzymes, and (4) amylase and lipase or lipolytic enzymes. Examples of such lipolytic enzymes are the cutinases. Peroxidases or oxidases have also proven suitable in some cases. Suitable amylases include, in particular, alpha-amylases, isoamylases, pullulanases and pectinases.

The enzymes can be adsorbed on carrier substances or embedded in coating substances in order to protect them against premature decomposition. The proportion of the enzymes, enzyme mixtures or enzyme granulates can, for example, be about 0.1 to 5% by weight, for example from 0.5% to about 4.5% by weight, in each case based on the total weight of the solid state detergent (102) or cleaner.

Solid state detergents (102) according to the present specification may include derivatives of diaminostilbenedisulfonic acid or alkali metal salts thereof as optical brighteners. Suitable examples are salts of 4,4'-bis(2-anilino-4-morpholino-1,3,5-triazinyl-6-amino)stilbene-2,2'-disulfonic acid or similarly constructed compounds which bear a diethanolamino group, a methylamino group, an anilino group or a 2-methoxyethylamino group instead of the morpholino group. In addition, brighteners of the substituted diphenylstyryl type may also be present, for example the alkali metal salts of 4,4'-bis(2-sulfostyryl)diphenyl, 4,4'-bis(4-chloro-3-sulfostyryl)diphenyl, or 4-(4-chlorostyryl)-4'-(2-sulfostyryl)diphenyl. Mixtures of the abovementioned brighteners can also be used.

Anti-caking agents which may be used in solid state detergent compositions (102) according to the present specification include many agents. For example, amorphous silicate material may be added to prevent and/or reduce agglomeration of the solid state detergent (102) into cakes. In another example, sodium bicarbonate, talcum powder or tricalcium phosphate may be used as an anti-caking agent. Additionally, aluminosilicates may have anti-caking activity. Accordingly, certain compounds—such as zeolites—may be able to provide more than one function, one of which may be preventing the agglomeration of the solid state detergent (102) into cakes.

The solid state detergent compositions (102) according to the present specification may also include pH adjusting agents. Such pH adjusting agents may be either acids or bases, and may be used to either raise or lower the pH. Examples of suitable pH adjusting agents, some of which may also be able to serve additional functions in the solid state detergent composition (102), include alkali and alkaline earth metal salts of carbonate, bicarbonate, hydroxide, phosphate, silicate, and combinations thereof. Further examples of suitable pH adjusting agents may also include inorganic and/or organic acids, provided that these are compatible with the other ingredients. For example, a pH adjusting agent may include solid mono-, oligo- and polycarboxylic acids, such as citric acid, tartaric acid, succinic acid, malonic acid, adipic acid, maleic acid, fumaric acid, oxalic acid, and polyacrylic acid. The anhydrides of organic acids may also be suitable, such as maleic anhydride and succinic anhydride.

Besides the above-noted components, a solid state detergent composition (102) according to the present specification may also contain other additives. Such additives include, for example, fragrances, fragrance carriers, fluorescent agents, dyes, color-transfer inhibitors, pH regulators, greying inhibitors, corrosion inhibitors, silicone oils, antiredeposition agents and soil release promoting agents.

The solid state detergent compositions (102) according to the present specification may include antiredeposition agents, which may also be able to act as soil release promoting agents. Examples of such agents include copolyesters containing dicarboxylic acid units, such as terephthalic acid or sulfoisophthalic acid, alkylene glycol units, such as ethylene glycol or propylene glycol, and polyalkylene glycol units, such as polyethylene glycol. Further examples of antiredeposition agents may include celluloses, such as carboxymethylcellulose, microfibrillar cellulose, nonionic celluloses, and the like.

A solid state detergent composition (102) according to the present specification may be produced according to various methods. Examples of suitable methods include extrusion, tableting, spray drying, granulation, spheronization, particle coating techniques, pelletizing, and combinations thereof. For example, a solid state detergent composition (102) according to the present specification may be obtained by sequential extrusion and granulation. In another example, a portion of the solid state detergent composition (102) according to the present specification may be prepared by granulation, while a separate portion may be prepared by extrusion, and these portions may be blended to prepare the solid state detergent composition (102). According to a further example, a solid state detergent composition (102) according to the present specification may be prepared by the sequence or combination of particle coating techniques, granulation, extrusion, and spheronization. In a still further example, a solid state detergent composition (102) according to the present specification may be prepared by extrusion, in which the extrudate is cut into spherical or cylindrical particles as the extrudate emerges from the die with a length:diameter ratio in the range of 1:1 to 3:1; in this example, these extruded and cut particles may be further processed by a rounding operation. A rounding operation, as in the final example, may be performed either before or after the extruded and cut particles have cooled below their softening temperature. In a further example, a portion of the solid state detergent composition (102) may be extruded at a temperature in the range of 35 degrees Celsius (° C.) to 75° C., such as in the range of 40° C. to 70° C., or in the range of 40° C. to 60° C. In a still further example, the solid state detergent composition (102) may be prepared by blending particles that have been prepared by different techniques, such as granulation, extrusion and spheronization.

A solid state detergent composition (102) may contain convex particles. Convex particles may be particles that curve outward. Convex particles may be particles such that the shortest path between any two points on a single particle passes through, or is tangent to the surface of, the particle. The particles of a solid state detergent composition (102) may be considered convex particles if at least 60% of the particles are convex. For example, the particles of a solid state detergent composition (102) may be considered convex if 80%, for example 85%, of the particles are convex. In another example, the particles of a solid state detergent composition (102) may be considered convex if at least 90%, for example at least 95%, of the particles are convex. In a further example, the particles of a solid state detergent composition (102) may be considered convex if at least 98%, for example 100%, of the particles are convex.

A solid state detergent composition (102) according to the present specification may be provided in a container (104). A container (104) may include a number of parts, including a main body of the container (104), which may hold the solid state detergent composition (102). The main body of the container (104) may include a handle portion. The main body of the container (104) may also include a bulk portion, which may be the portion of the main body of the container (104) that is not provided by a handle portion. The handle portion, if a handle portion is present, may be connected to the bulk portion of the container (104) so as to contain the solid state detergent composition (102), or may be configured so as to not contain the solid state detergent composition (102). A container (104) may also include an engagement portion (106), which may engage a cap (108). The cap (108) may seal the container (104); the cap (108) may be removable and replaceable. For the purposes of the present specification, the container (104) refers to the main body and the engagement portion (106); the cap (108) may be considered separate from the container (104) because the cap (108) may be separable from the container.

The solid state detergent composition (102) may be added to a container (104) according to the present specification up to a fill level of 80% to 95% of the total volume of the container (104). For example, the solid state detergent composition (102) may be added to a container (104) according to the present specification up to a fill level of from 85% to 90% of the total volume of the container (104). In another example, the solid state detergent composition (102) may be added to a container (104) according to the present specification up to a fill level of 87% to 92% of the total volume of a container (104). The total volume of a container (104) may be measured as either the total volume which a container (104) may contain, or as the volume measured up to the engagement portion (106).

A container (104) may be transparent. Transparency may be measured using ASTM International standard D-1003 (2013 revision) using light within the visible spectrum. Light within the visible spectrum may be light which has a wavelength from 400 nanometers (nm) to 700 nm, inclusive. ASTM International Standard D-1003 provides measurements of transparency that are in units of percent transmittance, which represents the percentage of incident light that is transmitted through the material. This measurement may be referred to as the degree of light transmission of the material. For the purposes of the present specification, a material may be said to be transparent if the percent transmittance of light within the visible spectrum, as measured by ASTM International Standard D-1003, is at least 60%. For example, the percent transmittance of a transparent material according to the present specification may be at least 85%, as measured by ASTM International Standard D-1003. The transparency of a container (104) may be a function of both the transparency of the material from which the container (104) is made, as well as the thickness of the material. Increasing the thickness of a transparent material may cause the material to appear less transparent.

ASTM International standard D-1003 (2013 revision) may also be used to measure the haze of a material. Haze may be a measurement of the scattering of light through a material, and may be expressed as a percentage of light that is scattered so that its direction deviates by more than a specified angle from the direction of the incident beam of light. The angle may be specified in accordance with ASTM International standard D-1003. As with the transparency measurements, haze measurements may be conducted with light in the visible spectrum. A lower value of haze indicates that the material being tested scatters a smaller fraction of the light. For example, a container (104) according to the present specification may be made from a material with a haze between 0% and 50%, such as from 0% to 30%, or from 0% to 15%.

A container (104) according to the present specification may have a thickness that allows a user to perceive the container as transparent. For example, a container (104) according to the present specification may have a wall thickness that ranges from 0.1 mm to 3.0 mm. In another example, a container (104) according to the present specification may have a wall thickness that ranges from 0.2 mm to 2.0 mm. In a further example, a container (104) according to the present specification may have a wall thickness that ranges from 0.4 mm to 1.5 mm.

A container (104) according to the present specification may also have a smooth or roughened surface. Surface roughness ($R_z$) may be measured using ISO 4287 (DIN 4728, 2009 revision). The surface roughness, $R_z$, may be the arithmetic mean of the absolute value of the profile departure with a provided length. For example, a container (104) according to the present specification may have a surface that is, or is perceived as, smooth. In another example, a container (104) according to the present specification may have a surface roughness, $R_z$ of between 0.1 micrometers (μm) and 50 μm as measured by ISO 4287. In a further example, a container (104) according to the present specification may have a surface roughness, $R_z$ of between 0.1 μm and 20 μm as measured by ISO 4287.

A container (104) may be said to be transparent if the main body of the container (104) is made from a transparent material of a thickness such that the contents of the container (104) are visible through the main body of the container (104). The transparency of the engagement portion may be considered separately from the transparency of the main body, and does not contribute to the determination of whether the container (104) is transparent.

The engagement portion (106) may be made from a transparent material, or from a material that is not transparent. If the engagement portion (106) is made from a transparent material, this material may be thin enough to allow contents to be visible through the engagement portion (106), or may be thick enough to obscure a view to the contents. In one example, both the container (104) and the engagement portion (106) are transparent. In another example, the container (104) is transparent, while the engagement portion (106) is not transparent.

Accordingly, the main body of a transparent container (104) according to the present specification may be made from a material that has a percent transmittance of light within the visible spectrum of at least 60%, such as, for example, at least 85%. The engagement portion (106) may be made from the same material as the main body of the container (104), or may be made from a different material. Using the same material for both the main body of a container (104) and the engagement portion (106) may decrease manufacturing costs, as well as allowing a seamless connection between the main body of the container (104) and the engagement portion (106). Using different materials for the main body of a container (104) and the engagement portion (106) may allow the materials chosen for each portion of the container (104) to be optimized for their intended purpose. For example, it may be advantageous to construct the main body of a container (104) from a plastic that is transparent and capable of being bent or deformed under pressure; it may also be advantageous to construct the engagement portion (106) of a container (104) from a plastic that is structurally stable enough to not readily deform. In one example, these advantages may be achieved by using the same material, but having different thicknesses for the engagement portion (106) and the main body portion of the container (104). In another example, these advantages may be achieved by using different materials for the engagement portion (106) and the main body portion of the container (104).

A transparent container (104) according to the present specification may be clear, or may contain a quantity of dye sufficient to provide a color to the container. For example, a container (104) according to the present specification may be a clear transparent container (104). In another example, a container (104) according to the present specification may be a green transparent container (104). In a further example, a container (104) according to the present specification may be a blue transparent container (104). There is no intention to limit the choice of dyes which may be used in a container (104) according to the present specification; any color within the visible light spectrum may be suitable.

The use of a transparent container (104) according to the present specification may have a number of advantages. For example, a transparent container may allow a consumer to readily assess the quantity of solid state detergent (102) that remains inside the container (104), and use that information to determine the number of loads for which the remaining amount of solid state detergent (102) may be used. Additionally, a consumer may readily determine whether any residual solid state detergent (102) remains in a container (104) prior to discarding or recycling the container.

Containers (104) made from certain materials may also be more readily reused or recycled than containers (104) made from other materials. Accordingly, it may be suitable to use a material for the container (104) that is both transparent and readily reused or recycled in order to both decrease the ecological impact of such a container, as well as increase consumer appeal as a consequence of the decreased ecological impact.

A container (104) may be made of any suitable material, for example glass or plastic. A glass container (104) may have consumer appeal because the container (104) may be reusable. A glass container may also be recyclable; however, this may depend on the type of glass used for the container (104). For example, container glass may be readily recycled, while heat resistant glass may be more difficult to recycle. A plastic container (104) may be more economical to produce than a glass container (104), and may also be recyclable. Certain types of plastic, for example polyvinyl chloride (PVC), may be recycled with high efficiency. Other types of plastic, for example polystyrene (PS), may be more difficult to recycle.

Suitable materials which may be used for one or both of the engagement portion (106) and the main body portion of a container (104) according to the present specification include borosilicate glass, container glass, polypropylene (PP), polyethylene (PE), polyvinyl chloride (PVC), polycarbonate (PC), polystyrene (PS), and polyesters such as polyethylene terephthalate (PET), polyethylene terephthalate glycol-modified (PET-G), polycyclohexylenedimethylene terephthalate (PCT), polycyclohexylenedimethylene terephthalate glycol-modified (PCTG), polyhydroxybutyrate (PHB), and combinations thereof. For example, a container (104) according to the present specification may be prepared from a plastic resin that has been extruded, granulated or stretched. In another example, a container (104) according to the present specification may be made from polypropylene, which may be a random copolymer resin. In further example, a container (104) according to the present specification may be made from Moplen® RP241H, made by LyondellBasell (Rotterdam, Netherlands). In a still further example, a container (104) according to the present specification may be made from RB307MO, made by Borealis (Vienna, Austria). In another example, a container (104) according to the present specification may be made from 6D83K, made by Braskem (Sio Paulo, Brazil).

A container (104) according to the present specification may also include an agent that blocks or absorbs ultraviolet (UV) light. The inclusion of an agent which blocks or absorbs UV light may prevent or reduce the degradation of light sensitive materials. UV light may be light which has a wavelength in the range of 280 nm to 400 nm, inclusive. Any agent which blocks or absorbs UV light may be suitable. For example, a container (104) according to the present specification may include as a UV absorbing agent avobenzone, octyl methoxycinnamate, ortho-hydroxy benzophenones, ortho-hydroxy phenyl triazines, and ortho-hydroxy phenyl hydrazines. In another example, a container (104) according to the present specification may use Clearshield® UV absorbers, made by Milliken Chemical (Spartanburg, S.C.). In a further example, a container (104) according to the present specification may use Lifostab® UV absorbers and/or Hindered Amine Light Stabilizers (HALS), made by Lifocolor (Lichtenfels, Germany), such as Lifostab® 1026 PE. In a still further example, a container (104) according to the present specification may include Cesa@-Light UV absorbers and/or HALS, made by Clariant (Muttenz, Switzerland), such as 0301117-ZN or 030118-ZN. In one example, UV absorbers and/or HALS may be included in the container (104) at a concentration of 0.1% to 2% by weight, such as from 0.5% to 1% by weight. In another example, a container (104) according to the present specification may use UV blockers, such as titanium dioxide or zinc oxide. In one example, a UV absorber, HALS or UV blocker is included in a container (104) according to the present specification, and reduces the intensity of incident UV light by an amount of from 0% to 25% of the intensity of the incident light, such as from 0% to 15% of the intensity of the incident light, or from 0% to 5% of the intensity of the incident light. In a further example, a UV absorber, HALS or UV blocker is included in a container (104) according to the present specification, and reduces the intensity of incident UV light by an amount of from 5% to 25%, such as from 5% to 15%, of the intensity of the incident light. In a still further example, the inclusion of a UV absorber, HALS or UV blocker does not affect the transmission of light in the visible spectrum.

A container (104) according to the present specification may be made by any suitable method. For example, a container (104) according to the present specification may be made by extrusion blow molding (EBM), injection stretch blow molding (ISBM), injection blow molding (IBM), or injection molding and thermoforming. The choice of method for preparing a container (104) may depend on the material(s) chosen for the container.

A container (104) according to the present specification may assume any suitable shape. In one example, a container (104) according to the present specification may be shaped into a bottle. Such a bottle may include a cap (108), which may be removable and replaceable. In another example, a container (104) according to the present specification may be shaped into a tub. For the purposes of the present specification, a tub may be a container (104) which has a base, a number of walls attached to the base, and an opening; these components may be arranged such that the opening is at least as large as the base. The joint between the base and walls of the tub may be rounded, or may be abrupt. A tub may have rounded corners, or corners which are not rounded, or combinations thereof. A tub may also include a lid, which may removably cover the opening to allow access to the solid state detergent (102) contained within the container (104). According to another example, the container (104) may be a transparent plastic box, which may include a removable lid portion. A box may be a type of tub that assumes the shape of a rectangular prism. According to another example, the container (104) may be in a shape similar to a tub or a box, such that the opening is only a fraction of the surface area of the side which includes the opening. In this example, the container may be removably sealed with either a cap or a lid.

Figure 2:
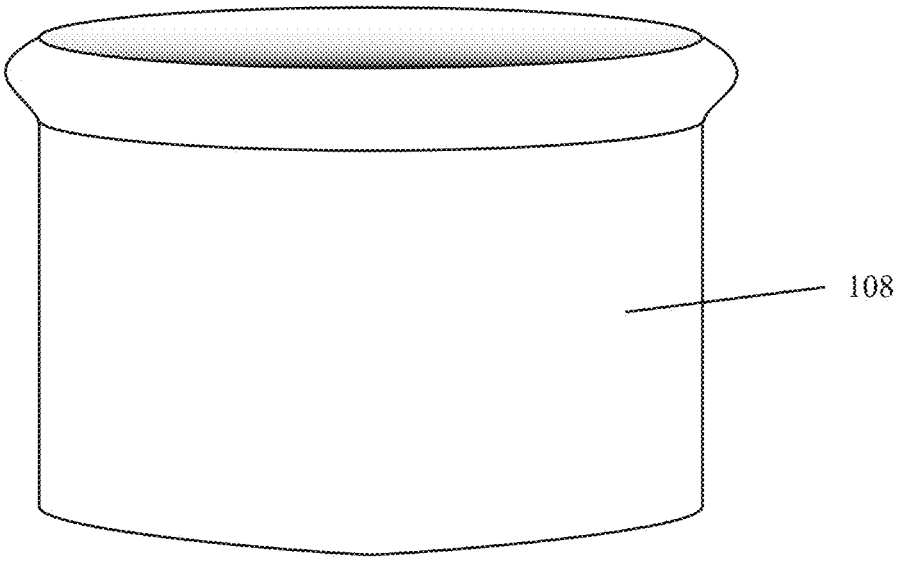
FIG. 2 is a diagram of a lid to a container for a cleansing product according to an example of the principles described herein.

A container according to the present specification may also include a cap (108). FIG. 2 shows a cap (108) which may accompany a container (104) according to an example of the principles described herein. The cap (108) may have a concave surface and/or a cavity. The cap (108) may act as a dosing or measurement device for the solid state detergent composition (102). The cap (108) may include a number of markings, which may be on the concave surface, or may be on a convex surface. A marking on the cap (108) may designate a quantity of the solid state detergent composition (102). A number of markings on the cap (108) may be used as measurement tools for the solid state detergent composition (102). In one example, a marking designates an appropriate quantity of the solid state detergent composition (102) that is suitable for use in a single wash cycle for laundry that has an ordinary degree of soiling. In another example, a marking designates an appropriate quantity of the solid state detergent composition (102) that is suitable for use in a single wash cycle for laundry that is heavily soiled. In principle, the number of markings on the cap (108) may enable facile measurement of any quantity of the solid state detergent composition (102).

The cap (108) may provide a replaceable seal to the container (104). The cap (108) may be easily removed from the container (104) and replaced onto the container (104). This may be accomplished by a mechanism that allows the cap (108) to engage the engagement portion (106) of the container (104). In one example, the cap (108) engages the engagement portion (106) of the container (104) by threading on the cap (108) that is matched with corresponding threading on the engagement portion (106) of the container (104). In another example, the cap (108) engages the engagement portion (106) of the container (104) using two raised rings, one of which is on the cap (108), and the other of which is on the engagement portion (106) of the container (104); upon application of a sufficient force, the rings may pass over one another, causing the cap (108) to be held in place.

The cap (108), which may include a concave surface and/or a cavity, may assume any appropriate configuration. For example, a concave surface of the cap may provide some of the interior surface of the container (104) when the cap (108) is used to seal the container (104). In another example, the cap (108) may be configured so that a concave surface provides some portion of the exterior surface of the container (104) when the cap (108) is used to seal the container. The cap (108) may have a concave surface and/or a cavity, such that the concave surface and/or cavity acts as a measurement tool for the solid state detergent composition (102) according to the present specification.

The cap (108) may be made from any suitable material. In one example, the cap (108) may be made of glass. In another example, the cap (108) may be made of plastic. The cap (108) may also be any appropriate color. For example, the cap (108) may be transparent, which may allow a user to observe the quantity of solid state detergent (102) that is in the cap (108) from any angle when the cap (108) is used to measure the solid state detergent (102). In another example, the cap (108) may be opaque, and may be any color. For example, the cap (108) may be red, blue, green, yellow, et cetera. There is no intention to limit the color choice of the cap (108); any color may be suitable. It may be advantageous for the color of the cap (108) to be readily distinguishable from the color of the solid state detergent (102), in order to enable facile measurement of the solid state detergent (102) using the cap (108). A cap (108) may be readily distinguishable from the color of the solid state detergent (102) if the cap (108) and the solid state detergent (102) are perceived by the naked eye as distinct colors. For example, a cap (108) that is red may be readily distinguishable from a solid state detergent (102) that is white with blue speckles. In another example, the cap (108) may be dark blue, and be readily distinguished from a solid state detergent (102) that is light blue in color. In contrast, a cap (108) that is green may not be readily distinguishable from a solid state detergent (102) that is the same hue of green as the cap (108).

The cap (108) may be entirely removable from the container (104), or may be attached to the container (104) using a flexible tether. Such a flexible tether may be made from any suitable material, for example, plastic or rubber. A flexible tether that attaches the cap (108) to the container (104) may allow for the cap (108) to be readily removed, and used to measure an appropriate amount of a solid state detergent (102), without risk of losing the cap (108).

Similarly, if a lid is used with a container (104) according to the present specification, the lid may be entirely removable, or may be partially removable. For example, the lid may bend along a living joint in order to provide access to the solid state detergent composition (102) inside the container (104).

Figure 3:
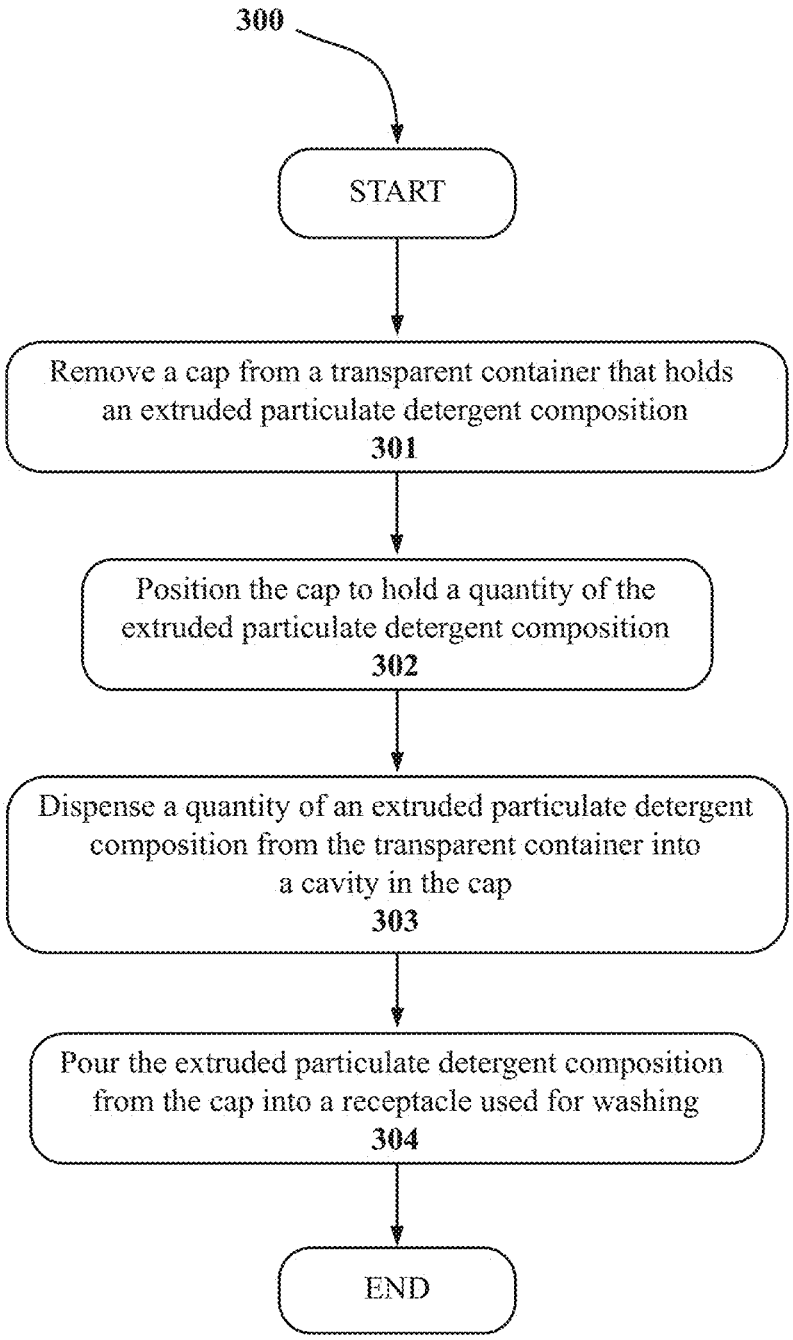
FIG. 3 is a flowchart of a method for dispensing a particulate detergent composition according to an example of the principles described herein.

The present specification also provides a method for dispensing a particulate detergent composition from a container. FIG. 3 provides a flowchart of a method (300) of dispensing a particulate detergent composition from a container according to an example of the principles described herein.

The method (FIG. 1, 108) (300) involves removing (301) a cap (FIG. 1, 108) from a transparent container (FIG. 1, 104) that holds an extruded particulate detergent composition (FIG. 1, 102). The removal of the cap (FIG. 1, 108) may be by any appropriate device, and may depend on the mechanism provided for the cap (FIG. 1, 108) to engage an engagement portion (FIG. 1, 106) of a container (FIG. 1, 104). For example, if the cap (FIG. 1, 108) engages the engagement portion (FIG. 1, 106) of a container (FIG. 1, 104) by corresponding threading on the cap (FIG. 1, 108) and the engagement portion (FIG. 1, 106), the cap (FIG. 1, 108) may be removed by rotation. In another example, the cap (FIG. 1, 108) may be removed by application of a force that is directed away from the main body of the container (FIG. 1, 104).

The method (300) may involve positioning (302) the cap (FIG. 1, 108) to hold a quantity of the extruded particulate detergent composition (FIG. 1, 102). This positioning may involve holding the cap (FIG. 1, 108) so that a concave surface or cavity is ready to receive the extruded particulate detergent composition (FIG. 1, 102). For example, the cap (FIG. 1, 108) may be positioned so that a cavity faces upward.

The method (300) may also involve dispensing (303) a quantity of an extruded particulate detergent composition (FIG. 1, 102) from the transparent container (FIG. 1, 104) into a cavity in the cap (FIG. 1, 108). The quantity of the extruded particulate detergent composition (FIG. 1, 102) may be measured using markings on the cap (FIG. 1, 108), which may be on either a concave surface (such as the cavity of the cap) or a convex surface of the cap (FIG. 1, 108). The quantity of the extruded particulate detergent composition (FIG. 1, 102) that is dispensed from the container (FIG. 1, 104) into the cap (FIG. 1, 108) may correspond to an appropriate amount of the extruded particulate detergent composition (FIG. 1, 102) for a single washing cycle.

The method (300) may also involve pouring (304) the extruded particulate detergent composition (FIG. 1, 102) from the cap (FIG. 1, 108) into a receptacle used for washing. Such a receptacle may be, for example, the dispensing drawer or dosing compartment of a mechanical washing machine, the drum of a mechanical washing machine, a wash basin, a dishwasher, a sink, et cetera. The method (300) may include additional operations. For example, the method (300) may also include replacing the cap (FIG. 1, 108) on the container (FIG. 1, 104).

EXAMPLES

The examples that follow indicate particulate solid state detergent compositions that may be prepared in accordance with the present specification. Unless otherwise indicated, the stated quantities are percentages by weight.

Example 1

Particulate Laundry Detergent Composition in a Transparent Container

| Formulation Example | Wt. % |
|---|---|
| Anionic Surfactant(s) | 15-23 |
| Nonionic Surfactant(s) | 3-10 |
| Builder(s) | 20-40 |
| pH Adjuster(s) | 2-8 |
| Bleaching Agent(s) | 18-24 |
| Bleach Activator(s) | 8-14 |
| Antiredeposition Agent(s) (coarse grade) | 0-3 |
| Optical Brightener(s) | 0-2 |
| Anti-caking Agent(s) | 0-2 |
| Fragrance | 0-2 |
| Enzymes (coarse grade) | 0.5-4.5 |
| Water | 0.5-6 |

The particulate laundry detergent composition was prepared by blending the anionic surfactant(s), nonionic surfactant(s), builder(s), and optical brightener(s), and extruding these materials to prepare extruded particles. The pH adjuster(s), bleaching agent(s), bleach activator(s), antiredeposition agent(s), anti-caking agent(s), fragrance, enzymes and water were added separately, following the extrusion process. For some of the materials that were added separately and are available in solid form, the material was obtained in a coarse grade, and may be sieved to provide particulates that are of a similar size to the extruded particles prior to admixture with the other components. A fraction of the particles were dyed, in order to create speckles within the particulate laundry detergent composition. The resultant particulate laundry detergent composition contains at least 50% by weight of extruded particles, relative to the total weight of the particulate laundry detergent composition. The resultant particulate laundry detergent composition contains at least 80% by weight, for example at least 90% by weight, and in another example at least 95% by weight, of particles with a size between 0.4 and 1.6 millimeters (mm). Following preparation of the extruded particulate laundry detergent composition, the composition was filled into a transparent plastic container to a fill level of approximately 85% to 90% of the total volume of the transparent plastic container. A cap, equipped with a number of markings to designate an appropriate amount of the extruded particulate laundry detergent for a single wash load, was then added to seal the transparent plastic container. The extruded particulate laundry detergent composition was readily visible through the transparent plastic container.

Example 2

Particle Size Distribution of Particles According to the Present Specification Vs. Comparative Particles For the data presented in the following table, two separate batches of particles were prepared according to the present specification. These are labeled Examples 2A and 2B. For comparison with the particles of the present specification, two commercially available particulate powder detergent compositions are also included. These are labeled Examples C2A and C2B. The amounts presented in the table below are weight percentages, relative to the total weight of the composition. Particle size is measured in millimeters (mm). The data shown in the following table demonstrate that the particle size of particulate detergents according to the present specification is generally larger, and also notably more homogenous, than the comparative examples.

| Particle Size | Ex. 2A | Ex. 2B | Ex. C2A | Ex. C2B |
|---|---|---|---|---|
| >2.0 mm | 0.0 | 0.1 | 0.6 | 0.7 |
| 1.8-2.0 mm | 0.6 | 0.5 | 0.4 | 0.4 |
| 1.6-1.8 mm | 2.9 | 3.0 | 0.7 | 0.7 |
| 1.4-1.6 mm | 24.3 | 25.6 | 1.8 | 1.7 |
| 1.25-1.4 mm | 16.8 | 17.1 | 2.0 | 1.9 |
| 1.0-1.25 mm | 18.1 | 18.7 | 5.6 | 5.6 |
| 0.8-1.0 mm | 12.1 | 12.3 | 8.0 | 8.1 |
| 0.6-0.8 mm | 13.1 | 12.5 | 17.4 | 17.1 |
| 0.4-0.6 mm | 9.4 | 8.3 | 19.5 | 19.8 |
| 0.2-0.4 mm | 1.8 | 1.2 | 18.6 | 18.7 |
| 0.15-0.2 mm | 0.3 | 0.2 | 6.4 | 7.1 |
| 0.1-0.15 mm | 0.3 | 0.1 | 8.1 | 11.1 |
| 0.05-0.1 mm | 0.1 | 0.1 | 9.5 | 6.1 |
| <0.05 mm | 0.0 | 0.0 | 0.6 | 0.2 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A consumer product for containing and dispensing a particulate detergent composition, comprising:

A. a transparent plastic container; and

B. a particulate detergent composition, in which the particulate detergent composition:

contains less than 5% by weight of particles with a diameter of less than 0.2 millimeters (mm); and contains less than 5% by weight of particles with a diameter of greater than 1.8 mm;

all weights being relative to the total weight of the particulate detergent composition.

2. The consumer product of claim 1, in which the particulate detergent composition comprises a number of anionic surfactants.

3. The consumer product of claim 1, in which the particulate detergent composition comprises a number of nonionic surfactants.

4. The consumer product of claim 1, in which the particulate detergent composition comprises extruded particles.

5. The consumer product of claim 1, in which at least 60% of the particles are convex.

6. The consumer product of claim 1, in which the particulate detergent composition contains less than 2% by weight of particles with a diameter of less than 0.2 mm, relative to the total weight of the composition.

7. The consumer product of claim 1, in which at least 80% of the particles of the particulate detergent composition have a diameter between 0.4 mm and 1.6 mm.

8. The consumer product of claim 1, in which the solid state laundry detergent composition has a dispensability in water of less than or equal to 15% residues by weight, relative to the total weight of the composition.

9. The consumer product of claim 1, in which the transparent container is made from a material that has a degree of light transmission of at least 60%.

10. The consumer product of claim 1, in which the transparent container comprises plastic.

11. The consumer product of claim 1, in which the transparent container is a bottle.

12. The consumer product of claim 1, in which the transparent container is a tub.

13. The consumer product of claim 1, further comprising a cap that acts as a measurement tool for the particulate detergent composition.

14. The consumer product of claim 13, in which the cap comprises a number of markings.

15. The consumer product of claim 14, in which a marking designates an amount of a detergent to be used for a single washing cycle.

16. A cleansing product for use as a laundry detergent, comprising:

a transparent container to hold a solid state laundry detergent composition; and a solid state laundry detergent composition that comprises:

a number of surfactants; and extruded particles;

wherein the solid state laundry detergent composition contains at least 60% by weight of convex particles.

17. The cleansing product of claim 16, in which the solid state laundry detergent composition is in particulate form and contains at least 50% by weight, relative to the total weight of the solid state laundry detergent composition, of extruded particles.

18. The cleansing product of claim 17, in which the solid state laundry detergent composition in particulate form contains less than or equal to 5% by weight of particles less than 0.2 millimeters (mm) in diameter, relative to the total weight of the composition.

19. The cleansing product of claim 18, in which the solid state laundry detergent composition in particulate form contains less than or equal to 5% by weight of particles greater than 1.8 mm in diameter, relative to the total weight of the composition.

20. A consumer product for containing and dispensing a particulate laundry detergent, comprising:

(a) a transparent plastic container that is made from a material that has a degree of light transmission of at least 60%; and (b) a particulate laundry detergent composition, comprising extruded particles, wherein the extruded particles comprise:

(i) from 10% to 40% by weight of a number of anionic surfactants; and (ii) from 1% to 30% by weight of a number of nonionic surfactants;

all weights being relative to the total weight of the particulate laundry detergent composition.

21. The consumer product of claim 20, in which the particulate laundry detergent composition further comprises an aluminosilicate.

22. The consumer product of claim 20, in which the particulate laundry detergent composition further comprises a solid source of oxidizing agent.

23. The consumer product of claim 22, in which the solid source of oxidizing agent comprises a percarbonate salt.

24. The consumer product of claim 22, in which the particulate laundry detergent composition further comprises a solid bleach activator.

25. The consumer product of claim 24, in which the solid bleach activator is tetraacetylethylenediamine.

* * * * *